US012070142B2

(12) United States Patent
Dobrusskin et al.

(10) Patent No.: US 12,070,142 B2
(45) Date of Patent: Aug. 27, 2024

(54) DRINKING VESSEL AND LID FOR A DRINKING VESSEL

(71) Applicant: KONINKLIJKE PHILIPS N.V., Eindhoven (NL)

(72) Inventors: Christoph Dobrusskin, Nuenen (NL); Amir Masoud Akbari Pazooki, Arnhem (NL); Alfredo Cerullo, Helmond (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 87 days.

(21) Appl. No.: 17/798,324

(22) PCT Filed: Feb. 7, 2021

(86) PCT No.: PCT/EP2021/052896

§ 371 (c)(1),
(2) Date: Aug. 9, 2022

(87) PCT Pub. No.: WO2021/165069

PCT Pub. Date: Aug. 26, 2021

(65) Prior Publication Data

US 2023/0095110 A1 Mar. 30, 2023

(30) Foreign Application Priority Data

Feb. 20, 2020 (EP) ..... 20158568

(51) Int. Cl.
*A47G 19/22* (2006.01)
*B65D 25/14* (2006.01)

(52) U.S. Cl.
CPC ..... *A47G 19/2272* (2013.01); *B65D 25/14* (2013.01)

(58) Field of Classification Search
CPC ..... A47G 21/18; A47G 19/2272; A47G 19/2266; A47G 19/2205; A47G 19/2222;
(Continued)

(56) References Cited

U.S. PATENT DOCUMENTS 3,346,133 A 10/1967 Herdman
4,244,477 A * 1/1981 Seel ..... B65D 51/24 220/759

(Continued)

FOREIGN PATENT DOCUMENTS

CN 105997522 A 10/2016
EP 2265152 B1 12/2014

(Continued)

OTHER PUBLICATIONS

International Search Report and Written Opinion Dated Apr. 16, 2021 for International Application No. PCT/EP2021/052896 filed Feb. 7, 2021.

*Primary Examiner* — Robert J Hicks

(57) ABSTRACT

A drinking vessel, and a lid for a drinking vessel are provided, The lid has a rim from which a user can drink with a valve formed at the rim. A fluid coupling extends from the valve to the base of the drinking vessel. Drinking is by sucking from the rim of the lid. The fluid coupling ensures that the cup does not have to be tipped (to bring the liquid in contact with the rim) as is the case for a conventional cup with a so-called 360 degree drinking valve.

20 Claims, 3 Drawing Sheets

(58) Field of Classification Search
CPC ..... B65D 25/14; B65D 1/40; B65D 2543/00046; B65D 2205/00
USPC .... 220/714, 711, 785, 784, 709, 705, 62.21, 220/62.12, 495.03; 215/229, 388, 387
See application file for complete search history.

(56) References Cited

U.S. PATENT DOCUMENTS

| | | | | |
|---|---|---|---|---|
| 5,651,471 | A * | 7/1997 | Green | B65D 47/243 222/545 |
| 5,890,619 | A | 4/1999 | Belanger | |
| 6,253,936 | B1 | 7/2001 | Kong | |
| 8,608,016 | B2 * | 12/2013 | Chiu | A47G 21/18 220/709 |
| 8,967,414 | B2 | 3/2015 | Lane | |
| 9,241,588 | B2 | 1/2016 | Dunn | |
| 9,801,481 | B2 | 10/2017 | Dunn | |
| 9,888,796 | B2 | 2/2018 | Dunn | |
| 10,117,533 | B2 | 11/2018 | Chen | |
| 2008/0314914 | A1 * | 12/2008 | Hacsi | A47G 19/2227 220/711 |
| 2010/0181329 | A1 * | 7/2010 | Davies | B65D 47/065 220/707 |
| 2011/0084084 | A1 | 4/2011 | Berg | |
| 2012/0061409 | A1 * | 3/2012 | Fioritto | B65D 77/286 220/710 |
| 2015/0102032 | A1 | 4/2015 | Dunn | |
| 2016/0120343 | A1 | 5/2016 | Liang | |
| 2017/0013985 | A1 | 1/2017 | Fan | |
| 2018/0042415 | A1 | 2/2018 | Dunn | |
| 2018/0344064 | A1 | 12/2018 | Miller | |

FOREIGN PATENT DOCUMENTS

| | | | |
|---|---|---|---|
| EP | 3345514 | A1 | 7/2018 |
| EP | 3381333 | A1 | 10/2018 |
| GB | 2401857 | A | 11/2004 |
| GB | 2562280 | A | 11/2018 |
| WO | 00/48491 | A1 | 8/2000 |
| WO | 03/061438 | A1 | 7/2003 |
| WO | 2012007731 | A2 | 1/2012 |
| WO | 2013/072822 | A1 | 5/2013 |
| WO | 2016038371 | A1 | 3/2016 |
| WO | 2017091639 | A1 | 6/2017 |
| WO | 2018215769 | A1 | 11/2018 |
| WO | 2019/110052 | A1 | 6/2019 |

* cited by examiner

DRINKING VESSEL AND LID FOR A DRINKING VESSEL

CROSS REFERENCE TO RELATED APPLICATIONS

This application is the U.S. National Phase application under 35 U.S.C. § 371 of International Application No. PCT/EP2021/052896 filed Feb. 7, 2021, which claims the benefit of European Patent Application Number 20158568.4 filed Feb. 20, 2020. These applications are hereby incorporated by reference herein.

FIELD OF THE INVENTION

The invention relates to drinking vessels, in particular drinking vessels which incorporate valves to prevent or reduce spillage.

BACKGROUND OF THE INVENTION

Drinking cups are well known for young children, and also for the elderly. Young children and the elderly may find it difficult to drink from ordinary open cups without spilling. This may be due to a lack of control over the cup or due to reduced mobility. It is known that cups with a lid having a drinking spout, or cups with a straw projecting through the lid, can provide considerable help with this issue.

It is also known to provide a cup with a valve arrangement in order to prevent liquid from flowing out if the cup is tipped. Indeed, there are many known designs of anti-spillage drinking cup.

One example is a cup having a spout equipped with a valve element. The valve is opened by means of an applied under-pressure (i.e. the user sucking), thereby opening the valve.

A cup with a built in spout or straw may inhibit proper oral development for young children. Furthermore, adults might be uncomfortable using a drinking cup with a spout or straw, since this advertises their reduced mobility issues to others around them.

It has been recognized that it would be desirable to emulate drinking from an open cup more closely, but retaining protection from spillage.

One approach is to provide drinking openings around the periphery of a cup lid. A valve actuated by suction may then be provided inside the lid, which responds to suction applied to any of the drinking openings.

Another known design makes use of a continuous 360 degree valve around the rim of a drinking cup. This enables a user to drink from any location and more closely replicates drinking from an open cup, whilst maintaining an anti-spillage function.

WO 2013/072822 discloses a 360 degree valve drinking cup in which pressure applied to the rim enables the user to drink from the rim without additionally needing to apply suction.

US 2016/0120343 discloses a drinking bottle which incorporates a lower straw tube leading to the base of the bottle, suspended beneath a partition. The user drinks through an upper straw above the partition. The valves are designed to prevent hot liquid leaving the drinking bottle when it is not desired.

U.S. Pat. No. 3,346,133 discloses a baby bottle in which a straw extends down from the teat to the base of the bottle. The straw connects to the teat with a plug member.

Many of the above designs are either complex to manufacture, difficult to clean, or even work in a unsatisfactorily way, providing too little liquid, spilling too easily, or providing a drink experience undesirably far removed from that of a common cup.

The use of straws is not preferred for young children because the development of a child's jaw or teeth may be impaired. With existing 360 degree valve drinking cups, the user has to tilt the cup at an angle to drink from it, and this may be difficult for some users.

There is therefore a need for an improved drinking cup design.

SUMMARY OF THE INVENTION

The invention is defined by the claims.

According to examples in accordance with an aspect of the invention, there is provided a lid for a drinking vessel, for mounting over a drinking vessel base, comprising:

- a rim from which a user can drink;
- a valve formed at the rim;
- a fluid coupling between the valve and the drinking vessel base,
- whereby a liquid drink in the drinking vessel base is maintained in fluid communication with the valve when the lid and valve are positioned above the drinking vessel base.

This lid enables a user to drink by sucking from a rim of the lid. The rim connects to the drinking vessel base through a fluid coupling. The use of this drinking vessel is more close to drinking from an open cup, so enables an infant to learn more quickly how to drink from a normal cup, but without the amount of spillage that would result from an open cup. The vessel does not have to be tipped (to bring the liquid in contact with the rim) as is the case for a conventional cup with a so-called 360 degree drinking valve. Instead, all of the drink contained in the drinking vessel base can be drawn through the valve without tipping the drinking vessel. This is because the liquid drink contained by the drinking vessel base is maintained, in use, in communication with the valve, even if the lid and valve are above the drinking vessel base, i.e. the drinking vessel does not need to be tipped to create a flow under gravity towards the valve. This communication with the valve is however preferably maintained even if the drinking vessel is tipped.

This fluid communication may be because there is a coupling to the bottom of the drinking vessel base, or because the drinking vessel base is filled with liquid and no air is allowed to enter during drinking.

Thus, the drinking vessel can be kept horizontal during drinking, but the drinking takes place from a rim of the lid which better emulates drinking from an open cup.

The use of a valve reduces the risk of spillage for young children. It also has advantages even for adult users. For example, a user can drink from the vessel while looking over the top instead of having to tip the vessel in front of their eyes. Thus, a user can maintain concentration while performing a visual task such as driving.

For an adult with reduced mobility, it enables spillage to be prevented but without needing to drink from a cup with a spout or straw (which some adults may find degrading).

Thus, the lid design enables a vessel to be formed which has the advantages of drinking through a straw (not needing to tip the vessel) and the advantage of a 360 degree cup (using a drinking technique which assists oral development and is not degrading).

The invention provides a design according to which a user employs suction at the rim of a drinking vessel. The design may use a one part lid, a many part lid, a lid whereby the valve element is inside the rim, a lid whereby the valve element is outside the rim, a single valve, many valves, etc.

In one preferred design, the valve extends fully around the rim. A rotationally symmetric rim may be used, giving a 360 degree valve.

In a first type of design, the valve is adapted to open in response to an externally applied positive pressure to a portion of the rim and to open in response to suction applied to the valve.

The valve opening in response to suction is mentioned above. The valve may also open due to applied physical pressure to a portion of the rim, e.g. by pressing with lips. This pressure may for example induce a rocking motion to open the valve. This enables drinking from the vessel without needing to suck, or without needing to suck as hard. This then emulates drinking from an open cup more closely. There are various known valve designs which implement this functionality.

In a second type of design, the valve is adapted to close in response to (only) an externally applied positive pressure to the outside of the rim and to open in response to (only) suction applied to the valve.

The valve opening in response to suction is again mentioned above. The valve closes (or closes tighter) due to applied physical pressure to a portion of the rim. This enables better resistance to spillage, since external forces are less likely to result in leakage.

There are many known valve designs which implement this functionality.

The lid may comprise a single part, wherein the valve is defined between the single part lid and the drinking vessel base. In such a case, the drinking vessel base is specially designed to implement part of the valve structure, and the drinking vessel base at least partly defines the drinking rim.

In another example, the lid may comprise:

a base unit for fitting over the drinking vessel base; and a cover part, wherein the cover part is attached to the base unit and defines a coupling chamber between them, wherein the valve is formed at an interface between the cover part and the base unit.

There is thus a two-part lid, and it may be used with a basic drinking vessel base, e.g. a drinking vessel base with a simple screw threaded top opening.

The cover part for example has a flexible outer edge and the base unit has a rigid, inwardly facing, edge, wherein the valve is formed at the interface between the flexible outer edge and the rigid edge. The flexible part is able to separate from the rigid part under the influence of suction applied at the rim. The reduced pressure outside the valve relative to the pressure inside the vessel causes the flexible part to lift away.

Any known 360 degree valve design may be used which implements this functionality.

The flexible outer edge is preferably biased outwardly against the rigid edge. This provides the desired valve closure, and hence prevention of spilling (even for an inverted cup) when suction is not applied.

In a first set of examples, the fluid coupling comprises a straw extending from the lid for projecting into the drinking vessel base. The straw may be formed in part by the wall of the drinking vessel base or it may be integrated into the design of the drinking vessel or it may be a freestanding projection extending beneath the lid.

For example, the straw extends down from the base unit of the lid, and the cover part encloses a chamber with the base unit. This chamber provides communication between the valve and the straw. It only needs a small volume, hence there is only a small amount of dead volume (i.e. volume which cannot be used for drink capacity).

The straw may be rigid. It for example extends to the base of the vessel. Alternatively, the straw may be flexible and have a weighted end. This means that if the vessel is tipped, the bottom of the straw will move to the lowest point of the base, which is where the remaining liquid is located. Thus, it makes it easier to drink all of the contents of the vessel.

The lid may further comprise an air valve coupling to a space directly beneath the lid. This enables the displaced liquid to be replenished with air.

However, the drinking vessel base may comprise a flexible bag so that the bag collapses when the drink is withdrawn. This avoids the need for an air valve.

The invention also provides drinking vessel comprising:

a drinking vessel base; and the lid as claimed in defined above having a straw, wherein the straw extends from the lid towards the bottom of the drinking vessel base.

The drinking vessel base may be a rigid cup (and the lid may then have an air valve) or it may be a flexible bag (so that no air valve is needed) or it may be a flexible bag inside a rigid cup (so the cup can be stood stably on a surface yet still use a flexible bag).

When a rigid outer cup is provided around a flexible bag, the space between them is vented so that the bag can collapse without needing to create a vacuum.

The invention also provides a drinking vessel comprising:

a drinking vessel base; and the lid as defined above, and wherein the drinking vessel base comprises a flexible bag and the fluid coupling is a coupling between the lid and the flexible bag at the underside of the lid.

This design avoids the need for a straw and an air valve, by having direct coupling from the lid to the top of the volume of the drinking vessel base. The drinking vessel base may further comprise a rigid cup around the flexible bag so that the drinking vessel may be used as a normal rigid cup. The flexible bag and lid may be removably attached to each other, and fluid communication may be established by opening a seal attached to the bag. Thus a pre-filled bag can be used and no or little "dead volume" is established by connecting the two.

These and other aspects of the invention will be apparent from and elucidated with reference to the embodiment(s) described hereinafter.

BRIEF DESCRIPTION OF THE DRAWINGS

For a better understanding of the invention, and to show more clearly how it may be carried into effect, reference will now be made, by way of example only, to the accompanying drawings, in which.

DETAILED DESCRIPTION OF THE EMBODIMENTS

Figure 1:
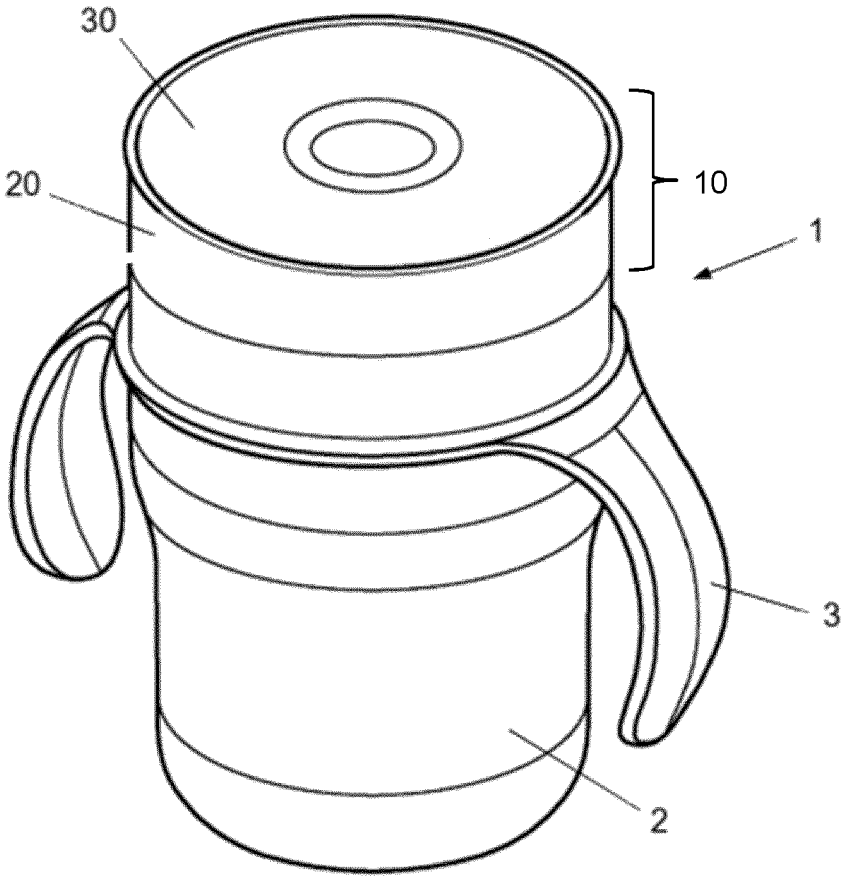
FIG. 1 shows a general example of a drinking vessel in the form of a spout-less cup with a 360 degree rim from which a user may drink.

The invention will be described with reference to the Figures.

It should be understood that the detailed description and specific examples, while indicating exemplary embodiments of the apparatus, systems and methods, are intended for purposes of illustration only and are not intended to limit the scope of the invention. These and other features, aspects, and advantages of the apparatus, systems and methods of the present invention will become better understood from the following description, appended claims, and accompanying drawings. It should be understood that the Figures are merely schematic and are not drawn to scale. It should also be understood that the same reference numerals are used throughout the Figures to indicate the same or similar parts.

The invention provides a drinking vessel, and a lid for a drinking vessel. The lid has a rim from which a user can drink with a valve formed at the rim, for example around the rim. A fluid coupling extends from the valve to the base of the drinking vessel. Drinking is by sucking from a rim of the lid. The fluid coupling means that the vessel does not have to be tipped (to bring the liquid in contact with the rim) as is the case for a conventional cup with a so-called 360 degree drinking valve.

FIG. 1 shows a general example of a drinking vessel in the form a drinking cup 1 including a rigid cup-shaped base 2 with a handle 3, and a lid 10. FIG. 1 shows an example of a spout-less drinking cup with a 360 degree rim from which a user may drink from any angular position around the rim by applying suction locally to the rim.

The drinking cup 1 is shown in an assembled state, i.e. a state in which the lid 10 is in place on the base 2 for covering an open side of the base 2. The base 2 contains liquid that is intended to be drunk by a user of the drinking cup 1.

The lid 10 is designed to assume one of two conditions, one condition being a default condition in which the lid prevents fluid communication between one side and the other, such that the drinking cup is closed, and another condition being an actuated condition in which the lid 10 allows fluid communication between the one side and the other, such that the drinking cup allows liquid to be supplied to a user.

One side of the lid 10 is an interior side that has an interior position in the drinking cup 1 in the assembled state, and another side of the lid 10 is an exterior side that has an exterior position of the drinking cup 1 in the assembled state of the drinking cup 1. Thus, in the default condition of the lid 10, a flow of liquid through the lid 10, from the interior side of the lid 10 to the exterior side of the lid 10, is prevented, while in the actuated condition of the lid 10, liquid is allowed to pass through the lid 10, from the interior side of the lid 10 to the exterior side of the lid 10.

The lid 10 comprises a base unit 20 and a cover part 30 that is accommodated by the base unit 20. The cover part 30 functions as a gasket. The actuated condition of the lid 10 is obtained on the basis of action taken by a user, in particular when a user has placed his/her lips at a portion of an exterior peripheral rim of the lid 10 and subjects the portion to a suction force. When the lid 10 is in the actuated condition, the liquid can be retrieved from the drinking cup 1 by tilting the drinking cup 1 to an appropriate extent.

The base unit 20 is for example made of a suitable rigid plastic, while the cover part (gasket) 30 is at least partially made of a suitable flexible material such as silicone. The cover part 30 may be coupled to the base unit 20 in any suitable way. The cover part 30 has a disc-shaped appearance. In the example shown, both the base unit 20 and the cover part 30 have a substantially circular periphery, however this is not essential.

The handle 3 can be integrally formed with either the drinking cup base 2 or the lid 10, or can be a separate component that is attachable to and detachable from the base 2 or the lid 10, and that is to be put in place by a user when assembling the drinking cup. Alternatively, there may be no handle.

As mentioned above, this design needs the user to tip the drinking cup so that liquid is present at the location from which the user is sucking.

Figure 2:
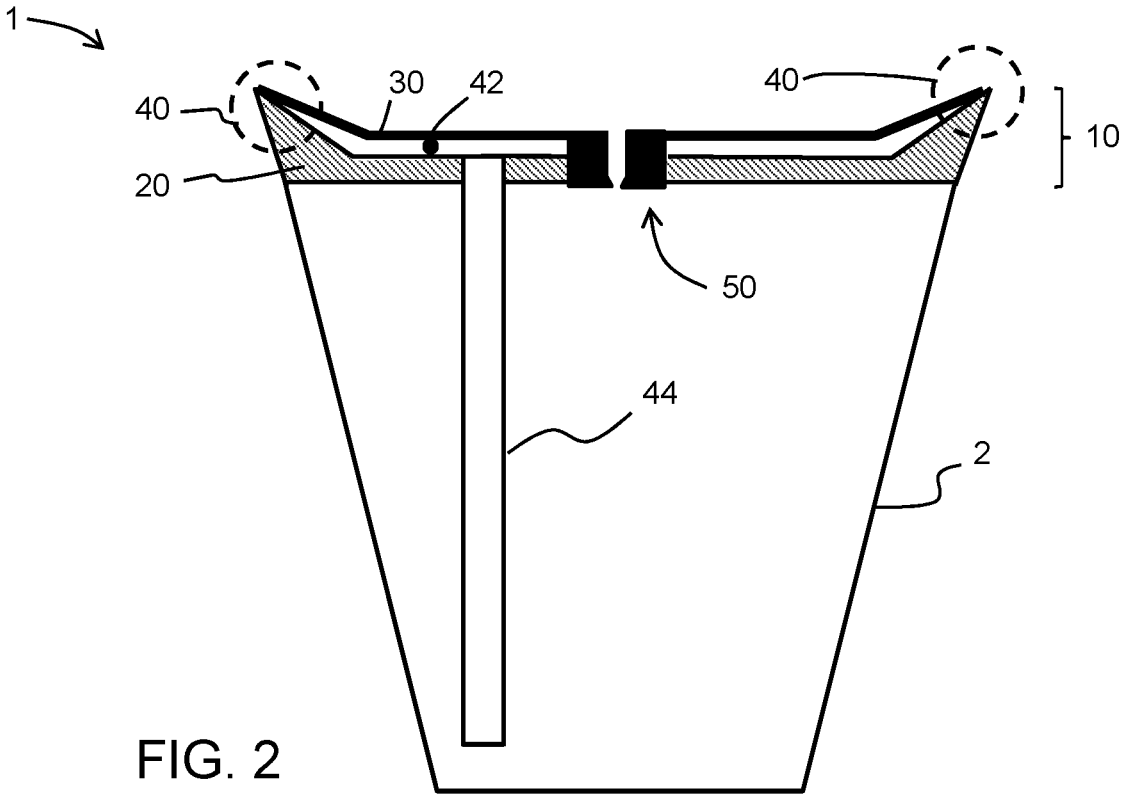
FIG. 2 shows an example of a drinking vessel in accordance with the invention.

FIG. 2 shows an example of a drinking vessel, such as a rigid drinking cup, in accordance with the invention as a modification to the design of FIG. 1. The drinking cup again comprises a lid 20 mounted over a drinking vessel base 2, i.e. drinking cup base. The lid 20 has a rim 40 from which a user can drink. A valve is formed at least partly around the rim. The valve is defined between a base unit 20 of the lid 10 which fits over the drinking cup base 2 and a cover part 30 of the lid 10 which functions as a gasket. The valve may be formed at defined drinking positions or it may extend fully around the rim, and hence define a continuous annular valve.

The cover part 30 is attached to the base unit 20 and a coupling chamber 42 is defined between them. The valve is formed at an interface between the cover part 30 and the base unit 20.

This first example has a straw 44 which extends down from the base unit 20. The coupling chamber 42 provides communication between the valve at the rim 40 and the straw 44 and thus functions as a fluid coupling between the valve and the straw. The coupling chamber 42 has a small height and hence only needs a small volume. Thus, there is only a small amount of dead volume.

The coupling chamber may, instead of a low depth chamber, comprise a number of smaller channels.

The cover part 30 has a flexible outer peripheral edge whereas the base unit 20 has a rigid, inwardly facing, edge. The flexible outer peripheral edge of the cover part 30 is able to separate from the rigid part under the influence of suction applied at the rim. The reduced pressure outside the valve relative to the pressure inside the cup causes the flexible edge to lift away from the rigid base unit 20 beneath and thereby allow liquid to flow.

The flexible outer peripheral edge is biased outwardly against the rigid edge of the base unit 20 to provide the desired valve closure, and hence spillage prevention.

A user can drink by sucking from the rim 40 of the lid 10. This is more close to drinking from a normal cup, so enables an infant to learn more quickly how to drink from a normal cup, but without the amount of spillage that would result from an open cup. The cup does not have to be tipped (to bring the liquid in contact with the rim) as is the case for a conventional cup with a 360 degree drinking valve. Thus, the benefits of using a straw are also obtained, namely that the drinking cup can be kept horizontal.

There are various possible designs for the valve.

In one known configuration, the valve may open in response to an externally applied positive pressure to a portion of the rim as well as opening in response to suction applied to the valve. An example is disclosed in EP 3 345 514.

The positive pressure in this general type of configuration for example results from applied physical pressure to a portion of the rim, e.g. by pressing with lips. There may be a dedicated area to which pressure is applied to open the valve, and this may be different to an area likely to be contacted if the cup is dropped. Thus, the protection against spillage is maintained even in the event of accidental dropping. A pressure applied to specific region of the rim for example induces a rocking motion to open the valve. This enables drinking from the cup without needing to suck, or without needing to suck as hard. This then emulates drinking from an open cup more closely.

In another more conventional known configuration, the valve will close in response to an externally applied positive pressure to the outside of the rim and only open in response to suction applied to the valve. This enables better resistance to spillage, since external forces are less likely to result in leakage. However, it means the user needs to be able to apply a certain level of suction to be able to use the drinking cup. There are also many known valve designs which implement this functionality.

The invention is not intended to be limited to any particular valve design, other than the valve design is for enabling drinking from the rim of the lid by applying suction.

FIG. 2 shows that lid 20 may further comprise an air valve 50 coupling to a space directly beneath the lid 20. This enables the displaced liquid to be replenished with air. It is a one-way valve allowing air to enter the cup base.

FIG. 2 shows a rigid straw 44 is rigid which extends to the base of the cup.

Figure 3:
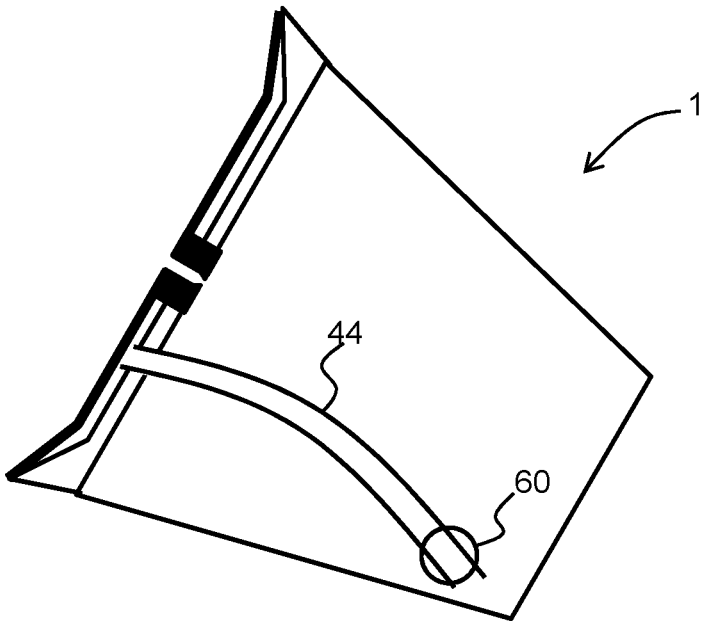
FIG. 3 shows a second example with a flexible weighted straw.

FIG. 3 shows a second example in which the straw 44 is flexible and has a weighted end 60. This means that if the cup is tipped as represented in FIG. 3, the bottom of the straw will move to the lowest point of the base, which is where the remaining liquid is located. Thus, it makes it easier to drink all of the contents of the cup.

Figure 4A:
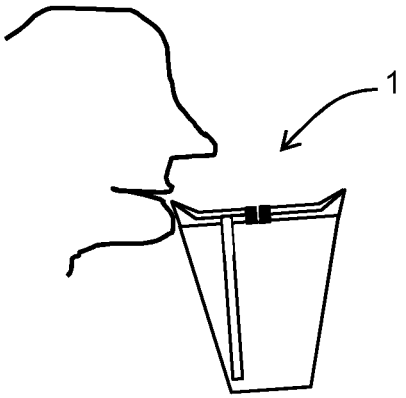
FIGS. 4A and 4B show a user drinking from a drinking vessel in accordance with the invention, and a user drinking from a conventional 360 degree drinking cup, respectively.
Figure 4B:
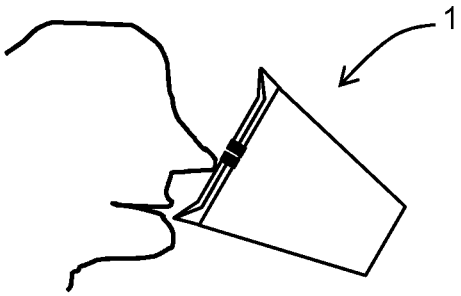

As mentioned above, the straw enables a user to drink from the cup in in a horizontal position. FIG. 4A shows a user drinking from a cup in accordance with the invention, and FIG. 4B shows a user drinking from a conventional 360 degree drinking cup. The advantage of FIG. 4A when performing a visual task such as when driving is clear.

The lid may fit to the drinking cup base by any suitable coupling such as a push fit or a screw fit. The drinking cup may be for training infants or for adults with mobility difficulties, or simply as a general alternative cup design e.g. for use when driving.

The straw provides a coupling between the lid and the bottom of the cup so that liquid is not needed in the vicinity of the rim. The straw may take any form, and is thus any fluid conduit between the lid (and in fluid communication with the valve) and the base. It does not for example need to have a constant cross sectional shape (in the manner of a typical straw).

The example above uses a rigid drinking vessel base, i.e. a cup base.

In each of FIG. 5, FIG. 6 and FIG. 7 described below, the lid 10 with the rim 40 is shown in different contexts for different embodiments.

Figure 5:
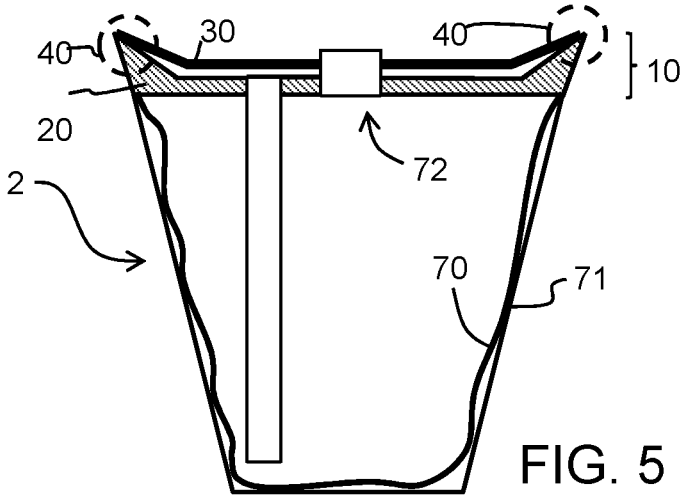
FIG. 5 shows third example in which the drinking vessel base comprises a flexible bag within a rigid cup.

FIG. 5 shows an example in which the drinking vessel base comprises a flexible bag 70 within a rigid cup 71. This avoids the need for an air vent. Instead, there may be a filling opening 72 which may be used to clean and refill the flexible bag. The straw ensures that the fluid coupling from the valve is to the base of the flexible bag so that fluid contact is maintained even if there is some air in the bag. The end of the straw for example has a design such that the straw opening cannot be blocked by the material of the flexible bag.

The use of a flexible bag also means the straw is not needed.

Figure 6:
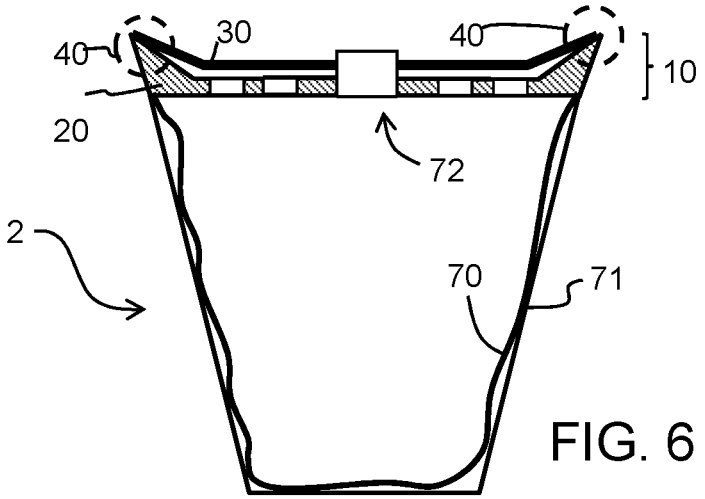
FIG. 6 shows a fourth example with no straw, and again with a flexible bag and rigid outer cup.

FIG. 6 shows an example with no straw, and again with a flexible bag 70 and rigid outer cup 71. A filling opening 72 is again shown.

Figure 7:
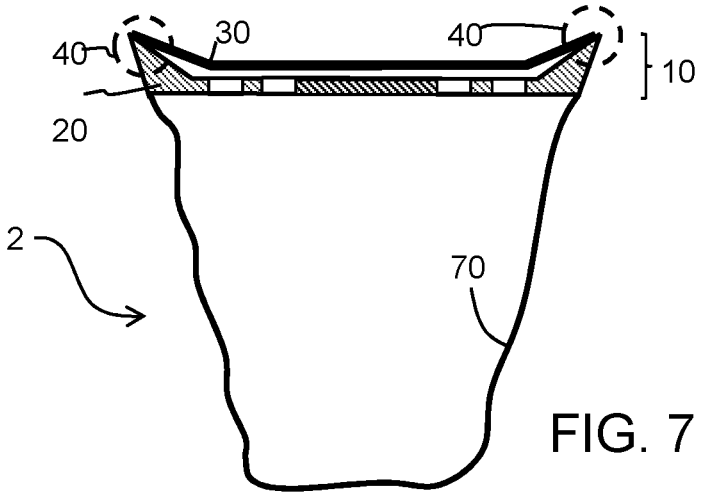
FIG. 7 shows a fifth example with no straw, and with only a flexible bag as the drinking vessel base.

FIG. 7 shows an example with no straw, and with only a flexible bag 70. This may be a disposable drinking pouch, and thus it has no refill opening. The fluid coupling is then only the coupling chamber 42.

In all examples above, the liquid drink in the drinking vessel is maintained in fluid communication with the valve (at least) when the lid and valve are positioned above the drinking vessel base. Thus, the fluid coupling, which may be a straw or a coupling to a flexible bag, enables the contents to be drunk by sucking at the rim, with the drinking vessel in a horizontal orientation.

The examples above are all based on the same lid valve design. Many other valve designs are possible. For example the drinking vessel base may form part of the valve structure, with a one-part lid.

The valve is preferably an annular 360 degree valve, but it may instead be located at one or more angular positions around the rim. For example, for a cup with two handgrips, a 360 degree valve is not needed, but two less than 180 degree valves (e.g. two 160 degree valves) may be used instead, with the area at the handgrips not forming a valve.

Variations to the disclosed embodiments can be understood and effected by those skilled in the art in practicing the claimed invention, from a study of the drawings, the disclosure and the appended claims. In the claims, the word "comprising" does not exclude other elements or steps, and the indefinite article "a" or "an" does not exclude a plurality.

The mere fact that certain measures are recited in mutually different dependent claims does not indicate that a combination of these measures cannot be used to advantage.

If the term "adapted to" is used in the claims or description, it is noted the term "adapted to" is intended to be equivalent to the term "configured to".

Any reference signs in the claims should not be construed as limiting the scope.

The invention claimed is:

1. A lid for a drinking vessel, for mounting over a drinking vessel base, comprising:

a rim which extends around an outer periphery of the lid and from which a user can drink;

a valve formed at the rim which is opened at least by suction applied to the valve; and a fluid coupling between the valve and the drinking vessel base, wherein the fluid coupling comprises:

a straw for insertion into a volume defined by the drinking vessel base when the lid is on the drinking vessel base; and/or a coupling to a flexible bag which forms the drinking vessel base or forms part of the drinking vessel base, whereby a liquid drink in the drinking vessel base is maintained in fluid communication with the valve when the drinking vessel is upright with the lid and valve positioned above the drinking vessel base.

2. The lid as claimed in claim 1, wherein the valve extends fully around the rim.

3. The lid as claimed in claim 1, wherein the valve is adapted to open in response to an externally applied positive pressure to a portion of the rim and to open in response to suction applied to the valve.

4. The lid as claimed in claim 1, wherein the valve is adapted to close in response to only an externally applied positive pressure to the outside of the rim and to open in response to only suction applied to the valve.

5. The lid according to claim 1, comprising:

a base unit for fitting over the drinking vessel base; and a cover part, wherein the cover part is attached to the base unit and defines a coupling chamber between the cover part and the base unit, wherein the valve is formed at an interface between the cover part and the base unit.

6. The lid as claimed in claim 5, wherein the cover part has a flexible outer edge and the base unit has a rigid, inwardly facing, edge, wherein the valve is formed at an interface between the flexible outer edge and the rigid edge.

7. The lid as claimed in claim 6, wherein the flexible outer edge is biased outwardly against the rigid edge.

8. A drinking vessel comprising:

a drinking vessel base; and the lid as claimed in claim 1, wherein the drinking vessel base comprises a flexible bag and the fluid coupling is a coupling between the lid and the flexible bag at an underside of the lid.

9. The drinking vessel as claimed in claim 8, wherein the drinking vessel base further comprises a rigid cup around the flexible bag.

10. The drinking vessel of claim 8, wherein the valve extends fully around the rim.

11. The drinking vessel of claim 8, wherein the valve is adapted to open in response to an externally applied positive pressure to a portion of the rim and to open in response to suction applied to the valve.

12. The drinking vessel of claim 8, wherein the valve is adapted to close in response to only an externally applied positive pressure to the outside of the rim and to open in response to only suction applied to the valve.

13. The drinking vessel of claim 8, wherein the lid further comprises:

a base unit for fitting over the drinking vessel base; and a cover part, wherein the cover part is attached to the base unit and defines a coupling chamber between the cover part and the base unit, wherein the valve is formed at an interface between the cover part and the base unit.

14. A lid for a drinking vessel, for mounting over a drinking vessel base, comprising:

a rim which extends around an outer periphery of the lid and from which a user can drink;

a valve formed at the rim which is opened at least by suction applied to the valve; and a fluid coupling between the valve and the drinking vessel base, wherein the fluid coupling comprises:

a straw for insertion into a volume defined by the drinking vessel base when the lid is on the drinking vessel base, whereby a liquid drink in the drinking vessel base is maintained in fluid communication with the valve when the drinking vessel is upright with the lid and valve positioned above the drinking vessel base, wherein the fluid coupling comprises the straw extending from the lid for projecting into the drinking vessel base.

15. The lid as claimed in claim 14, wherein:

the straw is rigid; or the straw is flexible and has a weighted end.

16. The lid as claimed in claim 14, further comprising an air valve coupling to a space directly beneath the lid.

17. A drinking vessel comprising:

a drinking vessel base; and the lid as claimed in claim 14, wherein the straw extends from the lid towards the bottom of the drinking vessel base.

18. The drinking vessel as claimed in claim 17, wherein the drinking vessel base comprises a rigid cup.

19. The drinking vessel as claimed in claim 17, wherein the drinking vessel base comprises a flexible bag.

20. The lid as claimed in claim 14, wherein the fluid coupling further comprises:

a coupling to a flexible bag which forms the drinking vessel base or forms part of the drinking vessel base.

* * * * *